US011300067B2

(12) United States Patent
Sumisha et al.

(10) Patent No.: US 11,300,067 B2
(45) Date of Patent: Apr. 12, 2022

(54) ELECTROMAGNETIC VALVE DRIVE DEVICE

(71) Applicant: KEIHIN CORPORATION, Tokyo (JP)

(72) Inventors: Noriaki Sumisha, Utsunomiya (JP); Takahiro Kogure, Sakura (JP); Kyohei Matsumoto, Sakura (JP); Daichi Kawakami, Shioya-gun (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 0 days.

(21) Appl. No.: 17/130,645

(22) Filed: Dec. 22, 2020

(65) Prior Publication Data

US 2021/0301748 A1 Sep. 30, 2021

(30) Foreign Application Priority Data

Mar. 24, 2020 (JP) ..... JP2020-052032

(51) Int. Cl.
*F02D 41/20* (2006.01)

(52) U.S. Cl.
CPC ..... *F02D 41/20* (2013.01); *F02D 2041/2055* (2013.01); *F02D 2041/2058* (2013.01); *F02D 2041/2065* (2013.01)

(58) Field of Classification Search
CPC ..... F02D 41/20; F02D 2041/2003–2093
See application file for complete search history.

(56) References Cited

U.S. PATENT DOCUMENTS

2012/0318883 A1* 12/2012 Kusakabe ..... F02D 41/20 239/1
2016/0177855 A1* 6/2016 Kusakabe ..... F02D 41/20 123/490

FOREIGN PATENT DOCUMENTS

JP 2002004922 A 1/2002
JP 2019027408 A 2/2019

* cited by examiner

*Primary Examiner* — Hung Q Nguyen
*Assistant Examiner* — Mark L. Greene
(74) *Attorney, Agent, or Firm* — Cantor Colburn LLP

(57) ABSTRACT

An electromagnetic valve drive device, that drives a fuel injection valve having a solenoid coil, includes a drive unit configured to drive the solenoid coil, an energization control unit configured to control energization for the solenoid coil by controlling the drive unit, a processing unit configured to obtain a current value arrival time, which is a time having elapsed from a start of energization for the solenoid coil until a current flowing through the solenoid coil reaches a predetermined current value, and an estimation unit configured to estimate a valve opening start time, which is a time from the start of the energization to a start of opening of the fuel injection valve on the basis of the current value arrival time.

9 Claims, 7 Drawing Sheets

ELECTROMAGNETIC VALVE DRIVE DEVICE

BACKGROUND OF THE INVENTION

Field of the Invention

Cross Reference to Related Applications

The present invention claims priority under 35 U.S.C. § 119 to Japanese Patent Application No. 2020-052032, filed Mar. 24, 2020, the entire content of which is incorporated herein by reference.

Description of Related Art

Japanese Unexamined Patent Application, First Publication No. 2002-004922 discloses an electromagnetic valve drive device that drives a fuel injection valve having a solenoid coil. This electromagnetic valve drive device energizes the solenoid coil and detects a timing of a peak (an inflection point) of a drive current that is a current flowing through the solenoid coil as a time at which valve opening starts.

The electromagnetic valve drive device adjusts an injection amount of fuel injected from a fuel injection valve by controlling a time duration from a time when valve opening starts to a time when the valve opening ends (a closing time).

SUMMARY OF THE INVENTION

However, a timing of an inflection point of a drive current may not always accord with a valve opening start time depending on a structure of the fuel injection valve (for example, refer to Japanese Unexamined Patent Application, First Publication No. 2019-27408).

That is, the valve opening may start after the inflection point of a drive current has occurred. In this case, since the inflection point of a drive current does not appear at the valve opening start time, the electromagnetic valve drive device cannot obtain the valve opening start time.

The present invention has been made in view of such circumstances, and an object thereof is to provide an electromagnetic valve drive device that can obtain the valve opening start time even when the valve opening starts after the inflection point of a drive current has occurred.

(1) One aspect of the present invention is an electromagnetic valve drive device that drives a fuel injection valve having a solenoid coil. The electromagnetic valve drive device includes: a drive unit configured to drive the solenoid coil; an energization control unit configured to control energization for the solenoid coil by controlling the drive unit; a processing unit configured to obtain a current value arrival time, which is a time having elapsed from a start of energization for the solenoid coil until a current flowing through the solenoid coil reaches a predetermined current value; and an estimation unit configured to estimate a valve opening start time, which is a time from the start of the energization to a start of opening of the fuel injection valve on the basis of the current value arrival time.

(2) In the electromagnetic valve drive device of (1) described above, the estimation unit may store information in which the current value arrival time and the valve opening start time are associated with each other, and may estimate the valve opening start time by obtaining the valve opening start time corresponding to the current value arrival time obtained by the processing unit from the information.

(3) In the electromagnetic valve drive device of (2) described above, the estimation unit may correct the current value arrival time obtained by the processing unit according to a temperature of the solenoid coil, and may estimate the valve opening start time by obtaining the valve opening start time corresponding to the corrected current value arrival time from the information.

(4) In the electromagnetic valve drive device of any one of (1) to (3) described above, the energization control unit may control an energization time for the solenoid coil such that a valve opening time, which is a time from an estimated value of the valve opening start time estimated by the estimation unit to a closing of the fuel injection valve, is always constant.

(5) In the electromagnetic valve drive device of (4) described above, the energization control unit may calculate a difference between a target value of the valve opening start time and an estimated value of the valve opening start time, and may correct a time at which energization for the solenoid coil stops on the basis of the difference such that the valve opening time is always constant.

As described above, according to the electromagnetic valve drive device according to the aspects of the present invention described above, it is possible to obtain a valve opening start time even when a valve starts to open after an inflection point of a drive current has occurred.

DETAILED DESCRIPTION OF THE INVENTION

Hereinafter, an electromagnetic valve drive device according to one embodiment of the present invention will be described with reference to the drawings.

Figure 1:
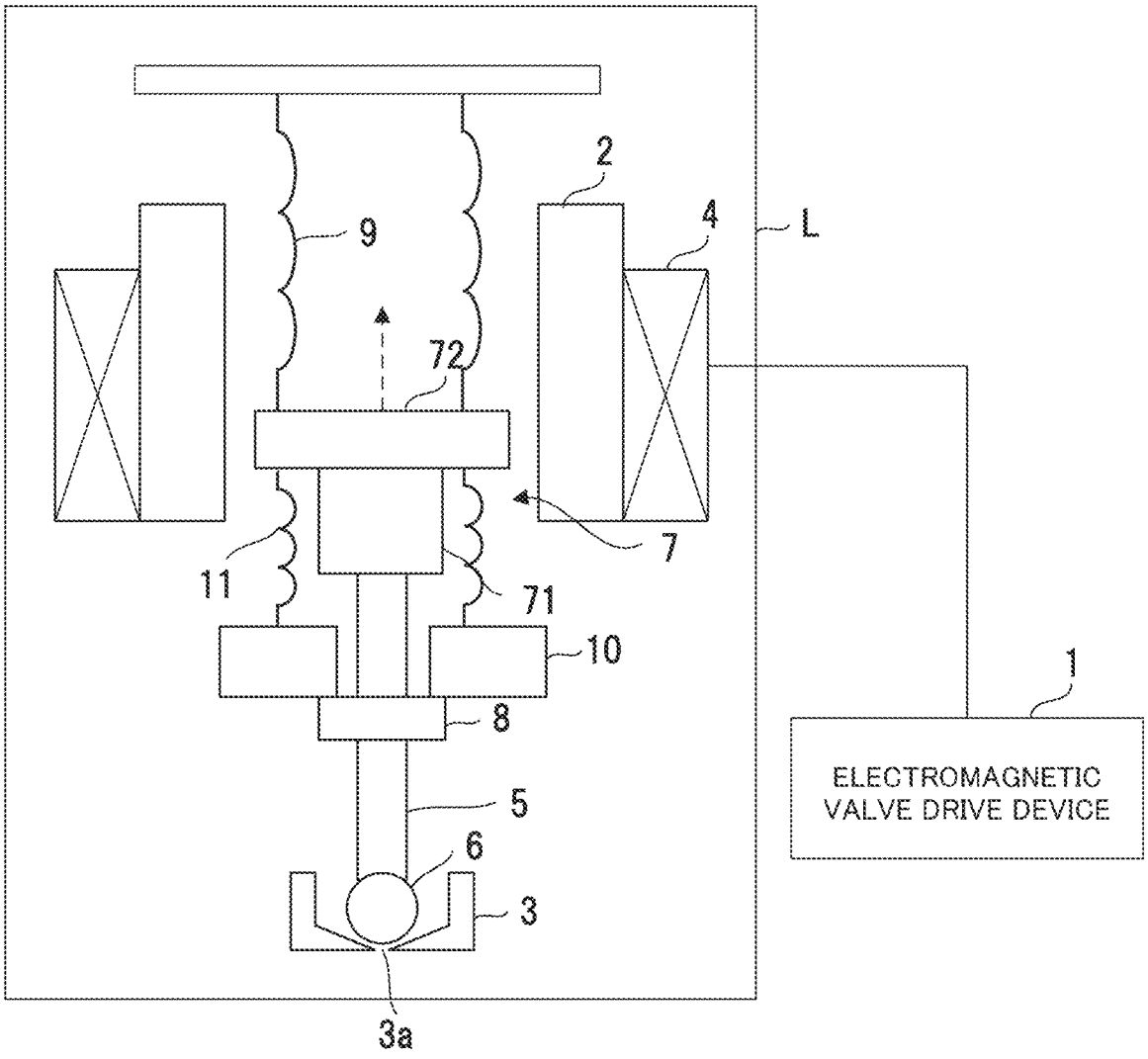
FIG. 1 is a diagram which shows a configuration example of a fuel injection valve L according to an embodiment of the present invention.

As shown in FIG. 1, the electromagnetic valve drive device 1 according to the present embodiment is a drive device for driving a fuel injection valve L. Specifically, the electromagnetic valve drive device 1 according to the present embodiment is an electromagnetic valve drive device which drives the fuel injection valve L (an electromagnetic valve) for injecting fuel into an internal combustion engine mounted in a vehicle.

The fuel injection valve L is an electromagnetic valve (a solenoid valve) that injects fuel into an internal combustion engine such as a gasoline engine or a diesel engine mounted in a vehicle.

In the following description, a configuration example of the fuel injection valve L will be described with reference to FIG. 1.

As shown in FIG. 1, the fuel injection valve L includes a fixed core 2, a valve seat 3, a solenoid coil 4, a needle 5, a valve body 6, a retainer 7, a lower stopper 8, a valve body urging spring 9, a movable core 10, and a movable core urging spring 11. In the present embodiment, the fixed core 2, the valve seat 3, and the solenoid coil 4 are fixed members, and the needle 5, the valve body 6, the retainer 7, the lower stopper 8, the valve body urging spring 9, the movable core 10, and the movable core urging spring 11 are movable members.

The fixed core 2 is a cylindrical member and is fixed to a housing (not shown) of the fuel injection valve L. The fixed core 2 is formed of a magnetic material.

The valve seat 3 is fixed to the housing of the fuel injection valve L. The valve seat 3 has an injection hole 3*a*.

The injection hole 3*a* is a hole through which fuel is injected, and is closed when the valve body 6 is seated on the valve seat 3 and is open when the valve body 6 is separated from the valve seat 3.

The solenoid coil 4 is formed by winding an electric wire in an annular shape. The solenoid coil 4 is disposed concentrically with the fixed core 2.

The solenoid coil 4 is electrically connected to the electromagnetic valve drive device 1. The solenoid coil 4 is energized from the electromagnetic valve drive device 1 to form a magnetic path including the fixed core 2 and the movable core 10.

The needle 5 is a long rod member extending in a central axis of the fixed core 2. The needle 5 moves in an axial direction of the central axis of the fixed core 2 (an extending direction of the needle 5) due to a suction force generated by the magnetic path including the fixed core 2 and the movable core 10. Note that a direction in which the movable core 10 moves due to the suction force is referred to as an upward direction, and a direction opposite to the direction in which the movable core 10 moves due to the suction force described above is referred to as an downward direction in the axial direction of the central axis of the fixed core 2, in the following description.

The valve body 6 is formed at a lower tip of the needle 5. The valve body 6 closes the injection hole 3*a* when seated on the valve seat 3, and causes the injection hole 3*a* to open by being separated from the valve seat 3.

The retainer 7 includes a guide member 71 and a flange 72.

The guide member 71 is a cylindrical member fixed to an upper end of the needle 5.

The flange 72 is formed to project in a radial direction of the needle 5 at the upper end of the guide member 71.

A lower end surface of the flange 72 is a surface in contact with a movable core urging spring 11. In addition, an upper end surface of the flange 72 is a surface in contact with the valve body urging spring 9.

The lower stopper 8 is a cylindrical member fixed to the needle 5 between the valve seat 3 and the guide member 71. An upper end surface of this lower stopper 8 is a surface in contact with the movable core 10.

The valve body urging spring 9 is a compressed coil spring accommodated inside the fixed core 2, and is inserted between an inner wall surface of the housing and the flange 72. The valve body urging spring 9 biases the valve body 6 downward. That is, when the solenoid coil 4 is not energized, the valve body 6 is brought into contact with the valve seat 3 by an urging force of the valve body urging spring 9.

The movable core 10 is disposed between the guide member 71 and the lower stopper 8. The movable core 10 is a cylindrical member and is provided coaxially with the needle 5. This movable core 10 has a through hole formed at the center, through which the needle 5 is inserted, and can move in an extending direction of the needle 5.

An upper end surface of the movable core 10 is a surface in contact with the fixed core 2 and the movable core urging spring 11. On the other hand, a lower end surface of the movable core 10 is a surface in contact with the lower stopper 8. The movable core 10 is formed of a magnetic material.

The movable core urging spring 11 is a compressed coil spring inserted between the flange 72 and the movable core 10. The movable core urging spring 11 urges the movable core 10 downward. That is, the movable core 10 is brought into contact with the lower stopper 8 by an urging force of the movable core urging spring 11 when the solenoid coil 4 is not energized.

Next, the electromagnetic valve drive device 1 according to the present embodiment will be described.

Figure 2:
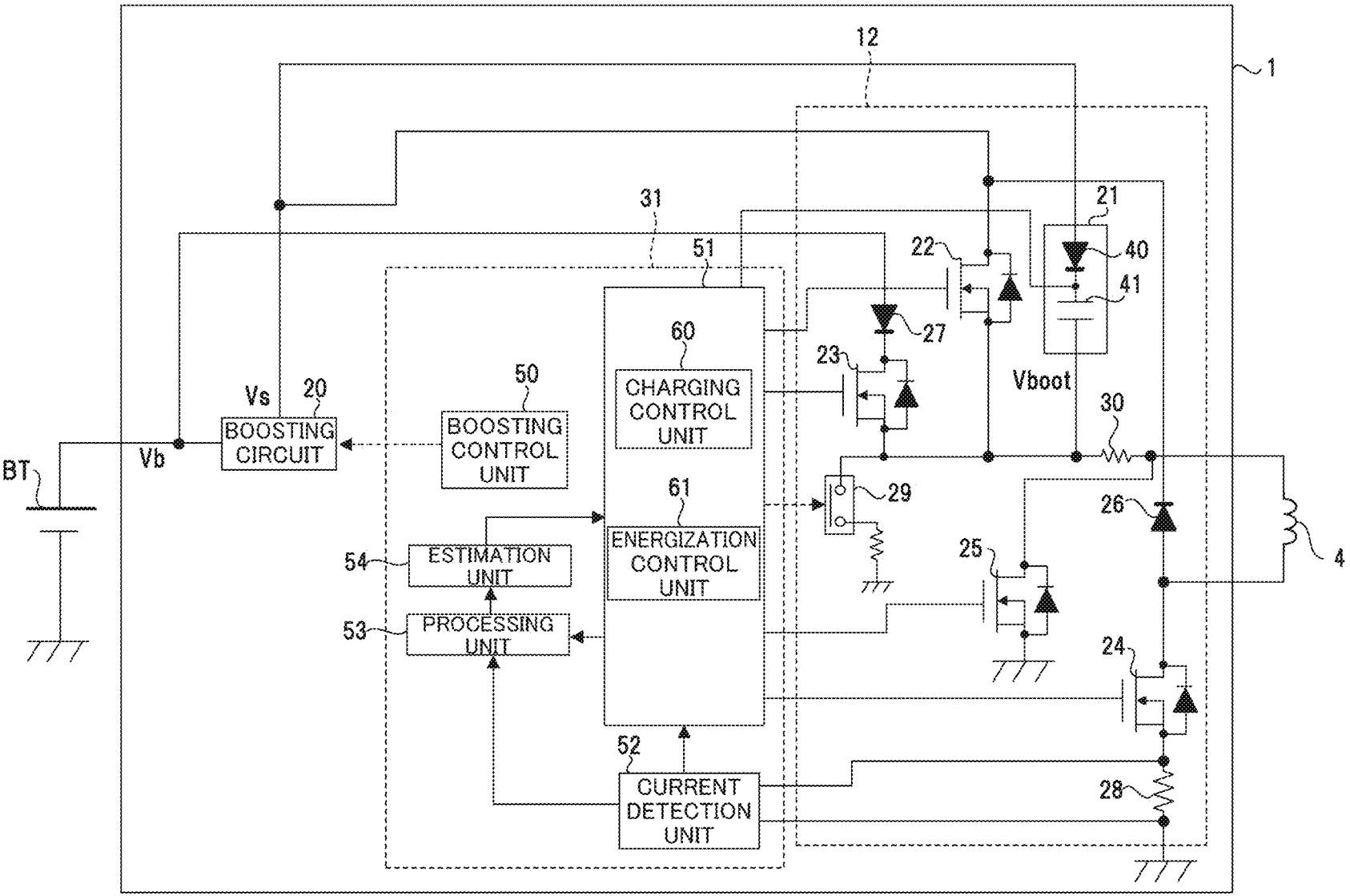
FIG. 2 is a diagram which shows a configuration example of an electromagnetic valve drive device 1 according to the embodiment.

As shown in FIG. 2, the electromagnetic valve drive device 1 includes a drive unit 12 and a control unit 31.

The drive unit 12 drives the solenoid coil 4 under control of the control unit 31. The drive unit 12 includes a boosting circuit 20, a bootstrap circuit 21, a first switching element 22 to a fourth switching element 25, a first diode 26, a second diode 27, a current detection resistor 28, a switch 29, and a resistor 30.

The boosting circuit 20 boosts a battery voltage Vb, which is an output voltage of a battery BT mounted in a vehicle, to a predetermined voltage. The boosting circuit 20 is, for example, a chopper circuit. The boosting circuit 20 generates a boosted voltage Vs by boosting the battery voltage. The boosting circuit 20 has a boosting ratio of, for example, about tens to several tens, and has an operation controlled by the control unit 31.

The bootstrap circuit 21 generates a voltage (hereinafter, referred to as a "boot voltage") Vboot required for controlling a switching element on a high side (hereinafter, referred to as a "high side switching element") in an on state. The high-side switching element is at least one of the first switching element 22 and the second switching element 23. The bootstrap circuit 21 generates a boot voltage based on the boosted voltage Vs. However, the present invention is not limited thereto, and the bootstrap circuit 21 may generate a boot voltage based on the battery voltage Vb. The bootstrap circuit 21 includes a diode 40 and a bootstrap capacitor 41.

An anode of the diode 40 is connected to the boosting circuit 20 and a cathode thereof is connected to the bootstrap capacitor 41. The cathode of diode 40 is connected to a drive control unit 51.

A first end of the bootstrap capacitor 41 is connected to the cathode of the diode 40 and a second end thereof is connected to each source of the first switching element 22 and the second switching element 23. The bootstrap circuit 21 generates the boot voltage Vboot when the bootstrap capacitor 41 is charged.

The first switching element 22 is, for example, a MOS transistor, and is provided between an output end of the boosting circuit 20 and a first end of the solenoid coil 4. That is, a drain of the first switching element 22 is connected to an output terminal of the boosting circuit 20, and a source thereof is connected to the first end of the solenoid coil 4 via the resistor 30. A gate of the first switching element 22 is connected to the control unit 31. An on or off (closing or opening) operation of the first switching element 22 is controlled by the control unit 31.

The second switching element 23 is, for example, a MOS transistor, and is provided between the output terminal of the battery BT and the first end of the solenoid coil 4. A drain of the second switching element 23 is connected to the output terminal of the battery BT via the second diode 27, and a source thereof is connected to the first end of the solenoid coil 4 via the resistor 30. A gate of the second switching element 23 is connected to the control unit 31. An on or off (closing or opening) operation of the second switching element 23 is controlled by the control unit 31.

The third switching element 24 is, for example, a MOS transistor, which is connected to the second end of the solenoid coil 4 and has a source connected to the first end of the current detection resistor 28. A gate of the third switching element 24 is connected to the control unit 31. The third switching element 24 has an on or off (closing or opening) operation controlled by the control unit 31.

The fourth switching element 25 is, for example, a MOS transistor, and has a drain connected to the first end of the solenoid coil 4 and a source connected to a ground (reference potential: GND). A gate of the fourth switching element 25 is connected to the control unit 31. The fourth switching element 25 has an on or off (closing or opening) operation, which is controlled by the control unit 31. The fourth switching element 25 is a switch that forms a route for regenerative current when it is in an on state (an open state).

A cathode of the first diode 26 is connected to the output terminal of the boosting circuit 20, and an anode thereof is connected to the second end of the solenoid coil 4.

A cathode of the second diode 27 is connected to the drain of the second switching element 23, and an anode thereof is connected to the output terminal of the battery BT. The second diode 27 is a diode for preventing a backflow. The second diode 27 prevents an output current of the boosting circuit 20 from flowing into the output end of the battery BT when both the first switching element 22 and the second switching element 23 are in the on state.

The current detection resistor 28 is a shunt resistor whose first end is connected to the source of the third switching element 24 and whose second end is connected to the reference potential (GND). The current detection resistor 28 is connected in series to the solenoid coil 4 via the third switching element 24, and a current flowing through the solenoid coil 4 passes through the current detection resistor 28. In the current detection resistor 28, a voltage (hereinafter, referred to as a "detection voltage") corresponding to a magnitude of the current flowing through the solenoid coil 4 is generated between the first end portion and the second end.

The switch 29 is a switch for charging the bootstrap capacitor 41. The switch 29 is connected between the first end of the solenoid coil 4 and the GND. The switch 29 may be, for example, an electrical switch such as a transistor, or may also be a mechanical switch.

A first end of the resistor 30 is connected to the second end of the bootstrap capacitor 41 and the switch 29, and a second end thereof is connected to the first end of the solenoid coil 4.

The control unit 31 controls the boosting circuit 20, and the first switching element 22 to the fourth switching element 25 based on a command signal input from an upper control system. For example, the control unit 31 is configured from a microprocessor such as a CPU or MPU, and an integrated circuit (IC) such as a microcontroller such as an MCU. In the following description, functional units of the control unit 31 will be described.

The control unit 31 includes a boosting control unit 50, a drive control unit 51, a current detection unit 52, a processing unit 53, and an estimation unit 54.

The boosting control unit 50 generates a boosting control signal (a PWM signal) for controlling an operation of the boosting circuit 20 and outputs the boosting control signal to the boosting circuit 20. As a result, the boosting circuit 20 generates the boosted voltage Vs.

The drive control unit 51 controls energization for the solenoid coil 4 by controlling the drive unit 12. When the fuel injection valve L is made to open, the drive control unit 51 energizes the solenoid coil 4 by applying the boosted voltage Vs or the battery voltage Vb to the solenoid coil 4. As a result, the fuel injection valve L starts to open after the energization for the solenoid coil 4 is started.

The current detection unit 52 detects a drive current Is, which is the current flowing through the solenoid coil 4. For example, the current detection unit 52 includes a pair of input terminals, one input terminal is connected to one end of the current detection resistor 28, and the other input terminal is connected to the other end of the current detection resistor 28. The current detection unit 52 receives an input of a detection voltage generated at the current detection resistor 28, and detects the drive current Is on the basis of this detection voltage. The current detection unit 52 outputs the detected drive current Is to the estimation unit 54 and the drive control unit 51.

Figure 3:
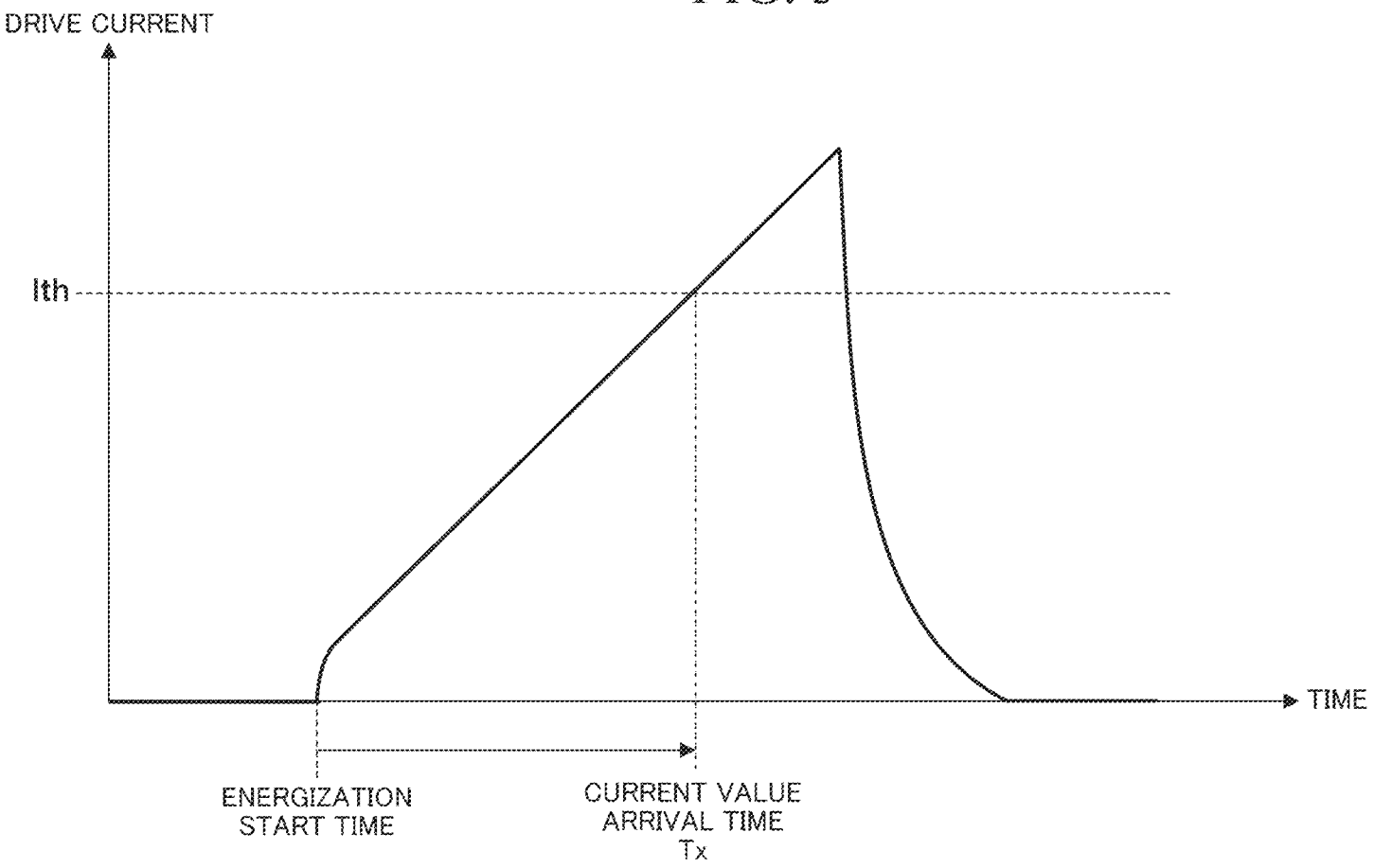
FIG. 3 is a diagram which shows a current value arrival time according to the embodiment.

As shown in FIG. 3, the processing unit 53 obtains a time (hereinafter, referred to as a "current value arrival time") Tx that has elapsed from the start of energization for the solenoid coil 4 to a time when the drive current Is flowing through the solenoid coil 4 reaches a predetermined current value Ith.

Specifically, the processing unit 53 starts time measuring from an energization start time, which is a time when the drive control unit 51 starts energization for the solenoid coil 4, and stops the time measuring when the drive current Is has reached the predetermined current value Ith. Then, the processing unit 53 outputs the current value arrival time Tx, which is a measured time, to the estimation unit 54.

For example, the predetermined current value Ith is set to an arbitrary drive current value during a rising period in a drive current waveform. However, the predetermined current value Ith is not limited to a rising period, and may also be set to an arbitrary drive current value during a falling period. Furthermore, an upper limit of the predetermined current value Ith is set to be equal to or less than a peak value of the drive current at the time of overlapping injection in which fuel is injected into a plurality of cylinders at the same time.

Figure 4:
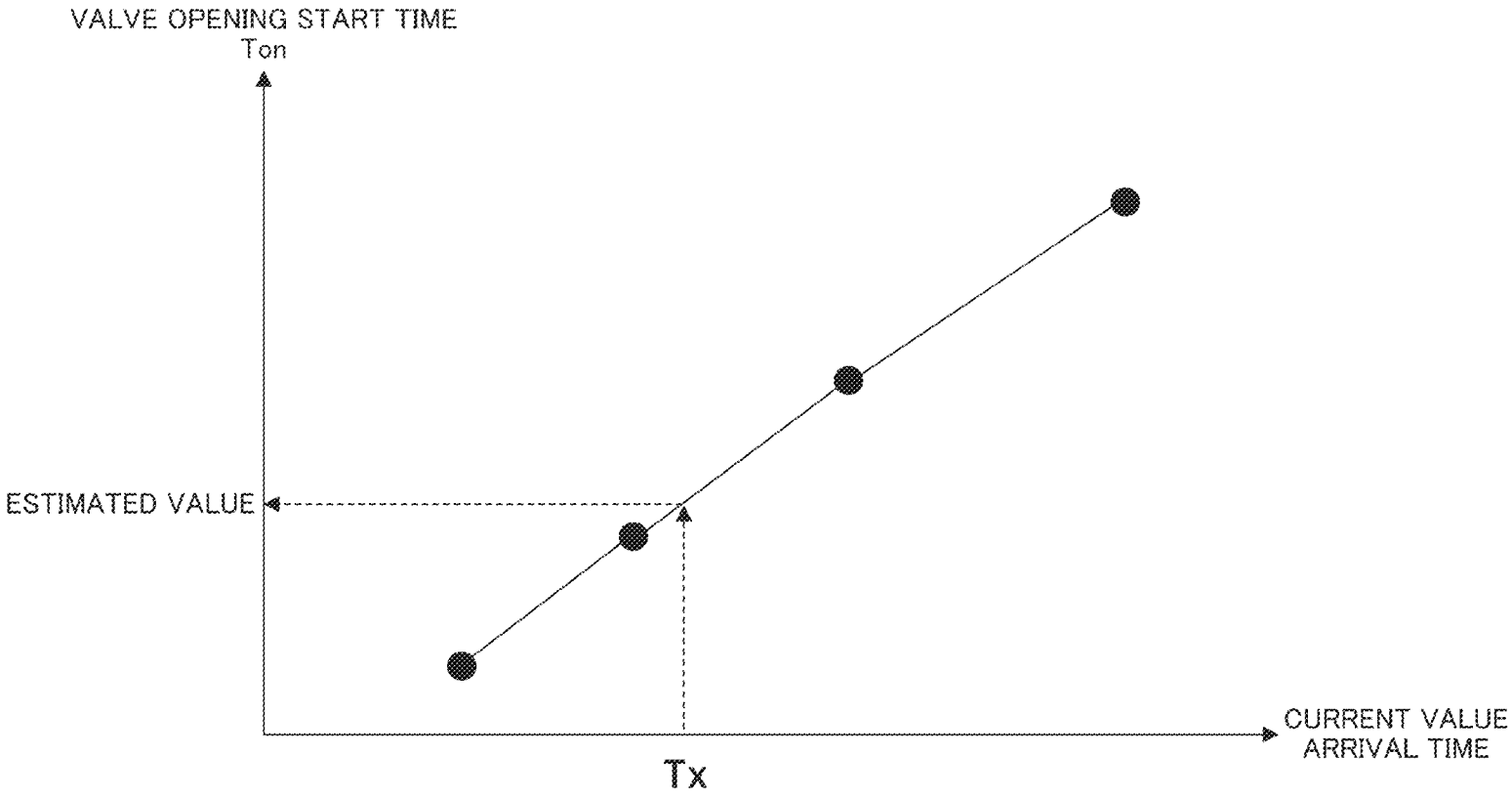
FIG. 4 is a diagram which shows a first correspondence information according to the embodiment.

Based on the current value arrival time Tx, the estimation unit 54 estimates a valve opening start time Ton, which is a time from the start of energization for the solenoid coil 4 to the fuel injection valve L starting to open. For example, the estimation unit 54 stores first correspondence information that is information in which the current value arrival time Tx and the valve opening start time Ton are associated with each other. As shown in FIG. 4, the present inventors have found that there is a correlation between the current value arrival time Tx and the valve opening start time Ton. FIG. 4 is a diagram which shows the first correspondence information that is correspondence information when a temperature t of the solenoid coil 4 is a predetermined temperature to (for example, 25° C.). The valve opening start time Ton is represented by a function in which the current value arrival time Tx is set as a variable. This is because a suction force for opening the fuel injection valve L is determined according to an amount of change in a drive current. This first correspondence information is information such as a mathematical formula or a table in which the current value arrival time Tx and the valve opening start time Ton are associated with each other.

The estimation unit 54 estimates the valve opening start time Ton by determining the valve opening start time Ton corresponding to the current value arrival time Tx obtained by the processing unit 53 from the first correspondence information.

Here, an inductance and impedance of the solenoid coil 4 have a temperature dependence. For this reason, a waveform of the drive current (a rising waveform) changes according to the temperature t of the solenoid coil 4. Therefore, the estimation unit 54 may correct the current value arrival time Tx according to the temperature t of the solenoid coil 4, and may estimate the valve opening start time Ton on the basis of the corrected current value arrival time Tx.

Figure 5:
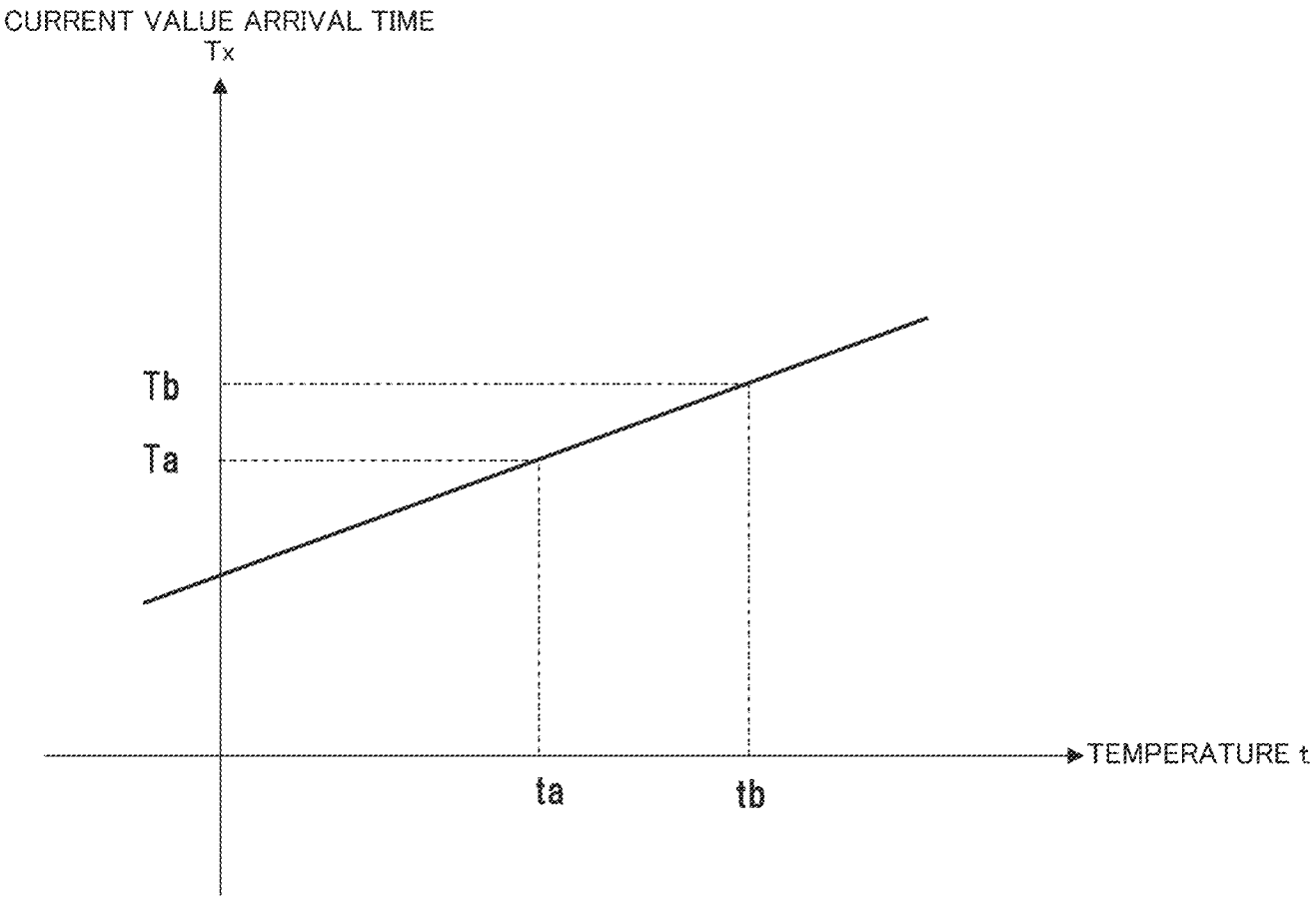
FIG. 5 is a diagram which shows a second correspondence information according to the embodiment.

For example, as shown in FIG. 5, the estimation unit 54 stores second correspondence information that indicates a correspondence between the temperature t of the solenoid coil 4 and the current value arrival time Tx in advance. The estimation unit 54 measures or estimates the temperature t of the solenoid coil 4. Then, the estimation unit 54 corrects the current value arrival time Tx obtained by the processing unit 53 using the temperature t of the solenoid coil 4. As an example, it is assumed that the temperature t of the solenoid coil 4 measured or estimated by the estimation unit 54 is tb (for example, 60° C.). Then, it is assumed that the current value arrival time Tx obtained by the processing unit 53 is Tb when the temperature t of the solenoid coil 4 is the temperature tb. In such a case, the estimation unit 54 can obtain information on a change in the current value arrival time Tx depending on a change in the temperature t of the solenoid coil 4 from the second correspondence information. Therefore, the estimation unit 54 can obtain the current value arrival time Ta when the temperature t of the solenoid coil 4 changes from the temperature tb to the temperature ta from the current value arrival time Tb. Here, FIG. 4 is the first correspondence information when the temperature t of the solenoid coil 4 is the temperature ta. Therefore, the estimation unit 54 may estimate the valve opening start time Ton by obtaining the valve opening start time Ton corresponding to the current value arrival time after temperature correction Tx (Ta) from the first correspondence information. Note that the second correspondence information is information such as a mathematical formula or a table in which the temperature t of the solenoid coil 4 and the current value arrival time Tx are associated with each other.

The drive control unit 51 includes a charging control unit 60 and an energization control unit 61.

The charging control unit 60 performs control such that the switch 29 is in an on state or an off state. The charging control unit 60 causes the bootstrap capacitor 41 to be charged by controlling the switch 29 such that it is in the on state. As a result, the bootstrap circuit 21 generates a boot voltage Vboot. For example, the charging control unit 60 causes the bootstrap capacitor 41 to be charged by controlling the switch 29 in the on state before injecting fuel into the internal combustion engine mounted in the vehicle.

The energization control unit 61 controls the energization for the solenoid coil 4 by controlling the drive unit 12. The energization control unit 61 performs control such that the first switching element 22 is in the on state or the off state. Specifically, the energization control unit 61 generates a first gate signal for controlling the first switching element 22, and outputs the first gate signal to a gate of the first switching element 22. As a result, the first switching element 22 is put into the on state.

The energization control unit 61 performs control such that the second switching element 23 is in the on state or the off state. Specifically, the energization control unit 61 generates a second gate signal for controlling the second switching element 23, and outputs the second gate signal to a gate of the second switching element 23. As a result, the second switching element 23 is put into the on state.

The energization control unit 61 performs control such that the third switching element 24 is in the on state or the off state. Specifically, the energization control unit 61 generates a third gate signal for controlling the third switching element 24, and outputs the third gate signal to a gate of the third switching element 24. As a result, the third switching element 24 is put into the on state.

The energization control unit 61 starts energization for the solenoid coil 4 by controlling the first switching element 22 or the second switching element 23 such that it is in the on state while the third switching element 24 is controlled to be in the on state. The energization control unit 61 controls an energization time for the solenoid coil 4 such that a time from an estimated value of the valve opening start time Ton estimated by the estimation unit 54 to a valve closing time, which is a time when the fuel injection valve L closes, after the start of energization (hereinafter, referred to as an "valve opening time") Topen is always constant. For example, the energization control unit 61 calculates a difference ΔT between a target valve opening start time Tp, which is a target value of a preset valve opening start time Ton, and the estimated value of the valve opening start time Ton, and corrects a time at which the energization for the solenoid coil 4 is stopped (hereinafter, referred to as a "energization stop time") on the basis of the difference ΔT such that the valve opening time Topen is always constant. As an example, the energization control unit 61 stops the energization for the solenoid coil 4 at a time longer by the difference ΔT from the preset energization stop time when the estimated value of the valve opening start time Ton is later than the target valve opening start time Tp by the difference ΔT. As a result, the energization control unit 61 can perform control such that the valve opening time Topen between a plurality of cylinders or for each vehicle is always constant, thereby reducing a variation in an amount of fuel injection.

Hereinafter, operations and effects of the present embodiment will be described.

Figure 6:
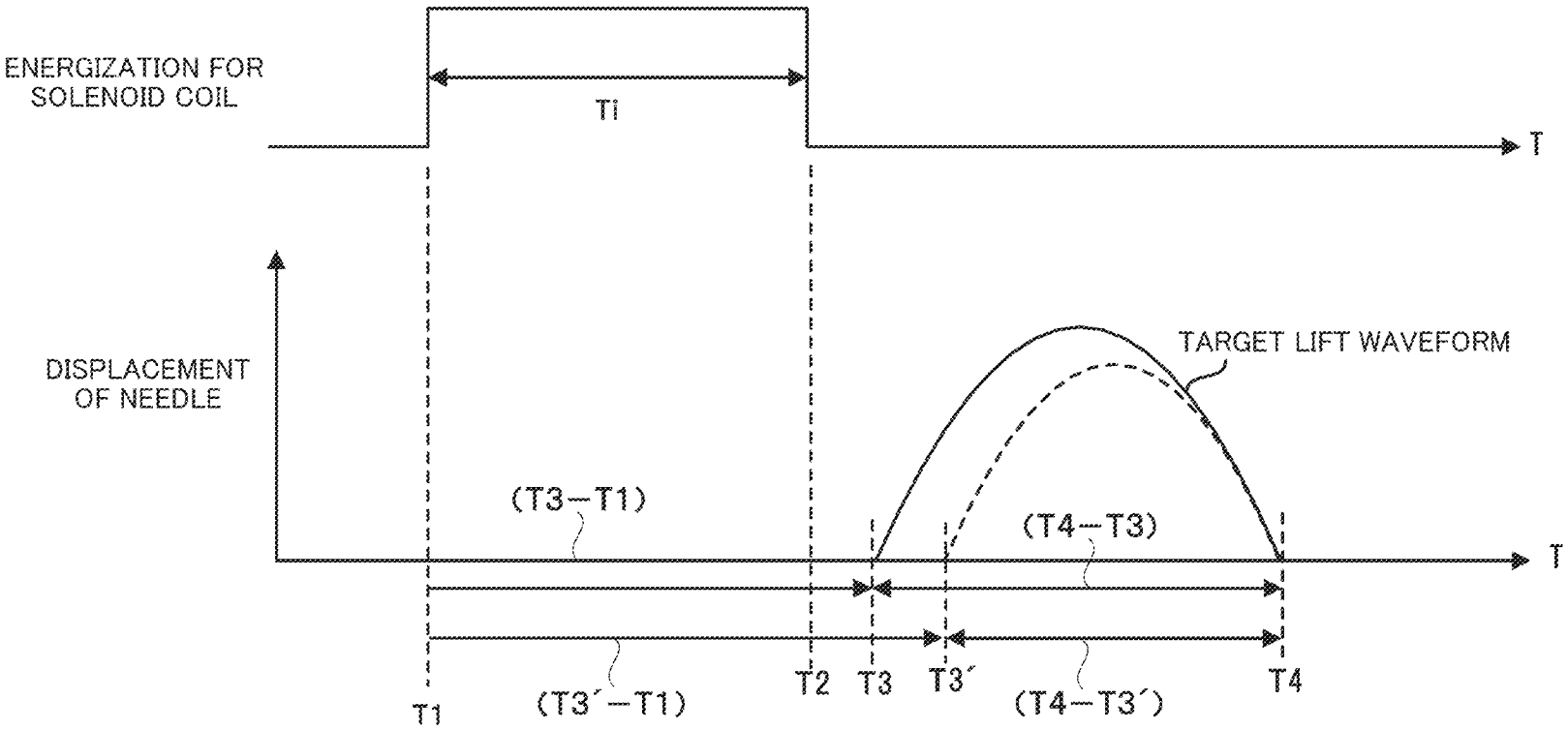
FIG. 6 is a diagram which shows a conventional method of energizing a solenoid coil 4.

First, a conventional method of energizing the solenoid coil 4 will be described with reference to FIG. 6. The energization control unit 61 starts the energization for the solenoid coil 4 at a preset time T1 (an energization start time). Then, the energization control unit 61 stops the energization for the solenoid coil 4 at a time T2 (an energization stop time) after a predetermined time T1 has elapsed from the time T1.

Here, when the solenoid coil 4 is energized, the fuel injection valve L forms a magnetic path including the fixed core 2 and the movable core 10, and causes the movable core 10 to move to a fixed core 2 side (upward) by a suction force generated by this magnetic path. That is, the needle 5 is moved upward by the suction force caused by a drive current, so that the valve body 6 is separated from the valve seat 3. However, the valve body 6 is separated from the valve seat 3 at a timing of the time T3 after the valve opening start time Ton has elapsed instead of a timing of the time T1 at which the energization is started. That is, there is a time lag between the start of the energization for the solenoid coil 4 and the start of opening of the fuel injection valve L in the fuel injection valve L of the present embodiment.

The fuel injection valve L starts to open at a time T3 when the valve opening start time Ton has elapsed from the energization start time T1, and closes at a time T4 when the valve opening time Topen has elapsed from the time T3. As a result, the energization control unit 61 performs control such that a displacement of the needle 5 draws a target lift waveform (a solid line in FIG. 6) which is a target lift waveform.

However, in reality, even if the energization for the solenoid coil 4 is started at the time T1, the fuel injection valve does not necessarily start to open at the time T3, and a variation occurs in the valve opening start time Ton. This is caused by a variation in a voltage value applied to the solenoid coil 4, and the like. For example, the fuel injection valve may start to open at a time T3' that is later than the time T3 (the time T3'−T1=the valve opening start time Ton). In this case, the displacement of the needle 5 is not a target lift waveform, and the valve opening time Topen is shortened from (T4−T3) to (T4−T3'). That is, an area of an actual lift waveform deviates from an area of the target lift waveform. The area of this lift waveform corresponds to the amount of fuel injection. Therefore, if the area of the lift waveform deviates from the area of the target lift waveform, the amount of fuel injection deviates from a target value of the amount of fuel injection. In this manner, if a variation occurs in the valve opening start time Ton, the valve opening time Topen also varies. As a result, the area of the target lift waveform also varies, and thereby a variation occurs in the amount of fuel injection.

Figure 7:
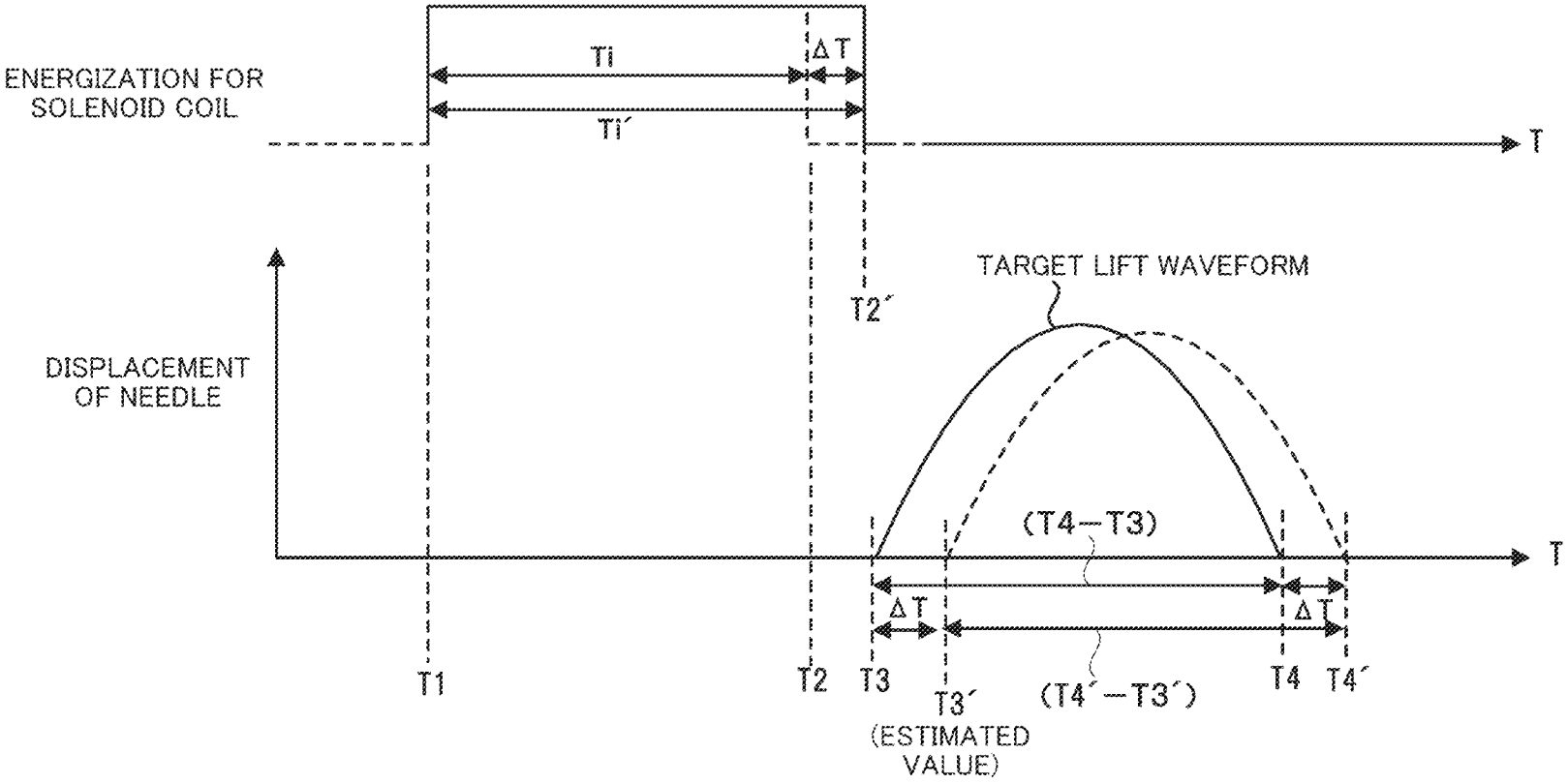
FIG. 7 is a diagram which shows a method of energizing a solenoid coil 4 in the embodiment described above.

Therefore, the control unit 31 of the present embodiment estimates the valve opening start time Ton on the basis of a drive current Is. Then, as shown in FIG. 7, the control unit 31 calculates a difference ΔT between the estimated value and the time T3, which is a target valve opening start time Tp of the valve opening start time Ton. Then, the control unit 31 sets an energization stop time to a time T2' (=T2+ΔT) delayed by the difference ΔT instead of the time T2, and stops the energization for the solenoid coil 4 at the time T2', which is the set energization stop time. As a result, the energization control unit 61 stops the energization for the solenoid coil 4 at the time T2' after a predetermined time Ti' (=Ti+ΔT) has elapsed from the time T1. As a result, the fuel injection valve L closes at a time T4' later than the time T4 by the difference ΔT. As a result, even if the valve opening start time Ton varies, the valve opening time Topen can be controlled to be always constant. As a result, the area of the actual lift waveform becomes substantially the same as the area of the target lift waveform, and it is possible to reduce the variation in the amount of fuel injection.

As described above, although the embodiment of the present invention have been described in detail with reference to the drawings, a specific configuration is not limited to the embodiment, and includes designs and the like within a range not departing from the gist of the present invention.

When the estimated value of the valve opening start time Ton is shorter than the target valve opening start time Tp by the difference ΔT, the energization control unit 61 of the present embodiment may stop the energization for the solenoid coil 4 at a time earlier than a preset energization stop time by the difference ΔT. As a result, the energization control unit 61 can perform control such that the valve opening time Topen between a plurality of cylinders or for each vehicle is always constant, and can reduce the variation in the amount of fuel injection.

As described above, the electromagnetic valve drive device 1 according to the present embodiment obtains a current value arrival time Tx that is a time having elapsed from the start of the energization for the solenoid coil 4 until the drive current Is flowing through the solenoid coil 4 reaches a predetermined current value Ith. Then, the electromagnetic valve drive device 1 estimates the valve opening start time Ton, which is a time from the start of energization to the fuel injection valve L starting to open, on the basis of the current value arrival time Tx.

According to such a configuration, the valve opening start time Ton can be obtained even when a timing of the inflection point of the drive current Is is not a valve opening start time due to the structure of the fuel injection valve L.

In addition, the electromagnetic valve drive device 1 controls an energization time for the solenoid coil such that a valve opening time (Topen), which is a time from the estimated value of an estimated valve opening start time Ton to the closing of the fuel injection valve L, is always constant. Specifically, when the estimated value of the valve opening start time Ton deviates from the target value (the target valve opening start time Tp), the electromagnetic valve drive device 1 corrects the deviation using the energization stop time.

According to such a configuration, even if an estimated value of the valve opening start time Ton deviates from a target value (the target valve opening start time Tp), the amount of fuel injection can be controlled to be constant.

Note that all or part of the control unit 31 described above may be realized in a computer. In this case, the computer may include a processor such as a CPU and a GPU and a computer-readable recording medium. Then, a program for realizing all or a part of functions of the control unit 31 in the computer is recorded in the computer-readable recording medium, and the program recorded in the recording medium is read and executed by the processor for the realization. Here, the "computer-readable recording medium" refers to a storage device such as a flexible disk, a magneto-optical disc, a portable medium such as an ROM or a CD-ROM, or a hard disk embedded in a computer system. Furthermore, the "computer-readable recording medium" may include a function that dynamically holds a program for a short period of time, such as a communication line when the program is transmitted via a network such as the Internet or a communication line such as a telephone line, and a function that holds the program for a certain period of time, such as a volatile memory inside the computer system serving as a server or a client in this case. Moreover, the program described above may be a program for realizing a part of the functions described above, may further be a program for realizing the functions described above in combination with a program already recorded in the computer system, and may also be a program realized using a programmable logic device such as an FPGA.

EXPLANATION OF REFERENCES

1 Electromagnetic valve drive device
4 Solenoid coil
31 Control unit
53 Processing unit
54 Estimation unit
61 Energization control unit
L Fuel injection valve

What is claimed is:

1. An electromagnetic valve drive device that drives a fuel injection valve having a solenoid coil, comprising:

a drive unit configured to drive the solenoid coil;

an energization control unit configured to control energization for the solenoid coil by controlling the drive unit;

a processing unit configured to obtain a current value arrival time, which is a time having elapsed from a start of energization for the solenoid coil until a current flowing through the solenoid coil reaches a predetermined current value; and an estimation unit configured to estimate a valve opening start time, which is a time from the start of the energization to a start of opening of the fuel injection valve on the basis of the current value arrival time.

2. The electromagnetic valve drive device according to claim 1, wherein the estimation unit stores information in which the current value arrival time and the valve opening start time are associated with each other, and estimates the valve opening start time by obtaining the valve opening start time corresponding to the current value arrival time obtained by the processing unit from the information.

3. The electromagnetic valve drive device according to claim 2, wherein the estimation unit corrects the current value arrival time obtained by the processing unit according to a temperature of the solenoid coil, and estimates the valve opening start time by obtaining the valve opening start time corresponding to the corrected current value arrival time from the information.

4. The electromagnetic valve drive device according to claim 3, wherein the energization control unit controls an energization time for the solenoid coil such that a valve opening time, which is a time from an estimated value of the valve opening start time estimated by the estimation unit to a closing of the fuel injection valve, is always constant.

5. The electromagnetic valve drive device according to claim 4, wherein the energization control unit calculates a difference between a target value of the valve opening start time and the estimated value of the valve opening start time, and corrects a time at which energization for the solenoid coil stops on the basis of the difference such that the valve opening time is always constant.

6. The electromagnetic valve drive device according to claim 2, wherein the energization control unit controls an energization time for the solenoid coil such that a valve opening time, which is a time from an estimated value of the valve opening start time estimated by the estimation unit to a closing of the fuel injection valve, is always constant.

7. The electromagnetic valve drive device according to claim 6, wherein the energization control unit calculates a difference between a target value of the valve opening start time and the estimated value of the valve opening start time, and corrects a time at which energization for the solenoid coil stops on the basis of the difference such that the valve opening time is always constant.

8. The electromagnetic valve drive device according to claim 1, wherein the energization control unit controls an energization time for the solenoid coil such that a valve opening time, which is a time from an estimated value of the valve opening start time estimated by the estimation unit to a closing of the fuel injection valve, is always constant.

9. The electromagnetic valve drive device according to claim 8, wherein the energization control unit calculates a difference between a target value of the valve opening start time and the estimated value of the valve opening start time, and corrects a time at which energization for the solenoid coil stops on the basis of the difference such that the valve opening time is always constant.

* * * * *